US009579771B2

(12) United States Patent
Cazzoli et al.

(10) Patent No.: US 9,579,771 B2
(45) Date of Patent: Feb. 28, 2017

(54) FLOOD COOLANT TO THROUGH SPINDLE COOLANT CONVERSION

(71) Applicant: Apple Inc., Cupertino, CA (US)

(72) Inventors: James R. Cazzoli, Hasting-on-Hudson, NY (US); Nathaniel H. Henderson, San Jose, CA (US); Christopher A. Hunt, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 385 days.

(21) Appl. No.: 14/094,249

(22) Filed: Dec. 2, 2013

(65) Prior Publication Data

US 2015/0151402 A1 Jun. 4, 2015

(51) Int. Cl.

| | |
|---|---|
| ***B24B 55/02*** | (2006.01) |
| ***B24D 13/10*** | (2006.01) |
| ***B24D 9/00*** | (2006.01) |

(52) U.S. Cl.

CPC ..... *B24B 55/02* (2013.01); *B24D 9/00* (2013.01); *B24D 13/10* (2013.01); *Y10T 29/49716* (2015.01)

(58) Field of Classification Search

CPC ..... B24B 55/02; B24D 13/00; B24D 9/00; B24D 13/10

USPC .... 451/450, 488, 53, 465, 466, 7; 125/11.22

See application file for complete search history.

(56) References Cited

U.S. PATENT DOCUMENTS 2,443,413 A * 6/1948 Bonkowski ..... B24D 9/003 15/230.1
3,144,739 A * 8/1964 Brutvan ..... B24D 5/06 451/450
4,493,170 A * 1/1985 Hanger ..... B24D 9/003 451/463
4,980,996 A 1/1991 Klink et al.
5,259,148 A 11/1993 Wiand
5,423,717 A * 6/1995 Boaz ..... B24D 5/10 451/449

(Continued)

FOREIGN PATENT DOCUMENTS

CN 2328469 7/1999
CN 200942477 9/2007

(Continued)

OTHER PUBLICATIONS

Chinese Patent for Utility Model No. ZL201420874291.2—Evaluation Report of Utility Model Patent dated Jul. 14, 2015.

*Primary Examiner* — Robert Rose
(74) *Attorney, Agent, or Firm* — Downey Brand LLP

(57) ABSTRACT

Rotary tools configured to sand components and accommodate complex geometries thereof are provided. The rotary tools may include a rotary head and a shaft. Bristles and an abrasive material may be coupled to the abrasive material. The rotary tools may additionally include outlets configured to receive a flow of coolant to cool the rotary tool. A system configured to convert a flood coolant system to a through spindle coolant system is also provided. The system may include a hollow shaft with inlets and a redirector therein. A flow receptor may include scoops that receive coolant sprayed from a flood coolant system and direct the coolant through the inlets in the hollow shaft. Thereby, the coolant may contact the redirector and be directed downward through the hollow shaft to a rotary tool, such as the rotary tool described above.

13 Claims, 18 Drawing Sheets

(56) References Cited

U.S. PATENT DOCUMENTS

| | | | | | |
|---|---|---|---|---|---|
| 5,941,664 | A * | 8/1999 | Morsch | B23Q 1/0036 | 408/57 |
| 5,993,297 | A * | 11/1999 | Hyatt | B24B 55/02 | 451/450 |
| 2006/0276117 | A1 * | 12/2006 | Jespersen | B24D 13/16 | 451/466 |

FOREIGN PATENT DOCUMENTS

| | | |
|---|---|---|
| CN | 101468443 | 7/2009 |
| CN | 201287294 | 8/2009 |
| CN | 101870087 | 10/2010 |
| EP | 0295453 | 12/1988 |
| JP | H0691533 | 4/1994 |
| JP | 2001198822 | 7/2001 |

* cited by examiner

FLOOD COOLANT TO THROUGH SPINDLE COOLANT CONVERSION

FIELD

The present disclosure relates generally to rotary machines, and more particularly to an apparatus configured to convert a flood coolant system to a through spindle coolant system and related rotary tools.

BACKGROUND

Components employed to form various devices such as computing devices often undergo numerous manufacturing operations during the production thereof. Additive manufacturing processes add material to form a component. By way of example, injection molding may be employed to form a component. Conversely, subtractive manufacturing processes remove material from a workpiece or substrate to form a component. For example, material may be machined from a substrate to form the component. In some embodiments additive and subtractive processes may both be employed to form a component, depending on the particular desired final configuration of the component.

Computer numerical control (CNC) machining is one example of a type of subtractive manufacturing process commonly employed to form components. CNC machining typically employs a robotic assembly and a controller. The robotic assembly may include a rotating spindle to which a milling cutter, or alternate embodiment of cutter, is coupled. The milling cutter includes cutting edges that remove material from a substrate to form a component defining a desired shape and dimensions. In this regard, the controller directs the robotic assembly to move the milling cutter along a machining path that forms the component.

However, CNC machining may not provide a desired surface finish. In this regard, various finishing operations, such as sanding followed by annodization, may thereafter be employed. However, sanding may be time consuming, may be difficult to implement on components defining complex geometries, and may in some instances cause defects to the component. Accordingly, improved component finishing operations and tools therefor may be desirable.

SUMMARY

Rotary tools configured to sand components and accommodate complex geometries thereof are provided. The rotary tools may include a rotary head and a shaft. Bristles and an abrasive material may be coupled to the abrasive material. The abrasive material may define tabs. Thereby, the bristles and the abrasive material may flex during impact with a component to allow for sanding of various components defining complex geometries. The shaft of the rotary tools may be hollow and the rotary tools may additionally include outlets configured to receive a flow of coolant therethrough to cool the rotary tool.

The rotary tool may be rotated using a CNC mill. However, many CNC mills include flood coolant systems, rather than through spindle coolant systems, which could deliver coolant to the rotary tool. Accordingly, a system configured to convert a flood coolant system to a through spindle coolant system is also provided. The system may include a hollow shaft with inlets and a redirector therein. A flow receptor may include scoops that receive coolant sprayed from a flood coolant system and direct the coolant through the inlets in the hollow shaft. Thereby, the coolant may contact the redirector and be directed downward through the hollow shaft to a rotary tool, such as the rotary tool described above. Alternatively, the rotary tool may include a cone configured to receive coolant therein and direct the coolant out of outlets in the tool head due to centripetal force.

Other apparatuses, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed apparatuses, assemblies, methods, and systems. These drawings in no way limit any changes in form and detail that may be made to the disclosure by one skilled in the art without departing from the spirit and scope of the disclosure.

DETAILED DESCRIPTION

Figure 1:
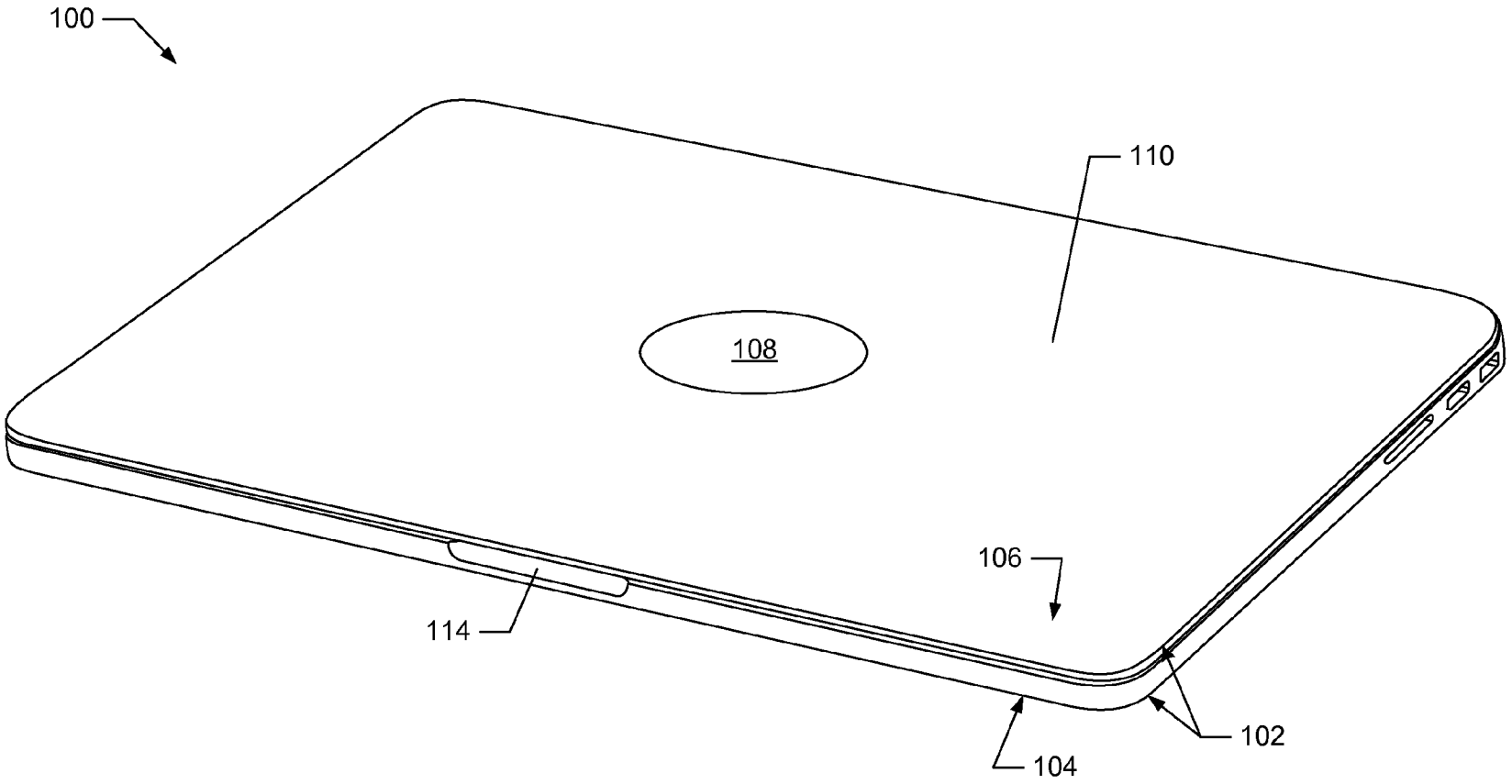
FIG. 1 illustrates a front facing perspective view of an embodiment of the portable computing device in a closed configuration according to an example embodiment of the present disclosure.

Representative applications of systems, apparatuses, computer program products and methods according to the presently described embodiments are provided in this section. These examples are being provided solely to add context and aid in the understanding of the described embodiments. It will thus be apparent to one skilled in the art that the presently described embodiments can be practiced without some or all of these specific details. In other instances, well known process steps have not been described in detail in order to avoid unnecessarily obscuring the presently described embodiments. Other applications are possible, such that the following examples should not be taken as limiting.

As described in detail below, the following relates to manufacturing and finishing tools, assemblies, apparatuses, systems, devices, computer program products, and methods. Embodiments of the disclosure may be employed to form a variety of components including, for example, electronic devices. By way of more specific example, the manufacturing and finishing methods disclosed herein may be employed to form a computing device such as a desktop computer, a laptop computer, a net book computer, a tablet computer, a cellphone, a smartphone, etc., or any accessory therefor such as a keyboard and a monitor. Thus, purely for purposes of example, embodiments of a portable computing device that may be formed by these manufacturing methods are described and illustrated herein. However it should be understood that various other embodiments of devices may be formed and finished using the tools, assemblies, apparatuses, systems, devices, computer program products, and methods of the present disclosure.

In one embodiment a portable computing device can include a multi-part housing having a top case and a bottom case joining at a reveal to form a base portion. The portable computing device can have an upper portion (or lid) that can house a display screen and other related components whereas the base portion can house various processors, drives, ports, battery, keyboard, touchpad and the like. The top case and the bottom case can each be joined in a particular manner at an interface region such that the gap and offset between top and bottom cases are not only reduced, but are also more consistent from device to device during the mass production of devices.

In a particular embodiment, the lid and base portion can be pivotally connected with each other by way of what can be referred to as a clutch assembly. The clutch assembly can include at least a cylindrical portion that in turn includes an annular outer region, and a central bore region surrounded by the annular outer region, the central bore suitably arranged to provide support for electrical conductors between the base portion and electrical components in the lid. The clutch assembly can also include a plurality of fastening regions that couple the clutch to the base portion and the lid of the portable computing device with at least one of the fastening regions being integrally formed with the cylindrical portion such that space, size and part count are minimized.

The top case can include a cavity, or lumen, into which a plurality of operational components can be inserted during an assembly operation. In the described embodiment, the operational components can be inserted into the lumen and attached to the top case in a "top-bottom" assembly operation in which top most components are inserted first followed by components in a top down arrangement. For example, the top case can be provided and shaped to accommodate a keyboard module. The keyboard module can include a keyboard assembly formed of a plurality of keycap assemblies and associated circuitry, such as a flexible membrane on which can be incorporated a switching matrix and protective feature plate. Therefore, following the top-bottom assembly approach, the keyboard assembly is first inserted into the top case followed by the flexible membrane and then the feature plate that is attached to the top case. Other internal components can then be inserted in a top to bottom manner (when viewed from the perspective of the finished product).

In one embodiment, the keyboard module can be configured in such a way that a keycap assembly can be used to replace a power switch. For example, in a conventional keyboard each of a top row of keycaps can be assigned at least one function. However, by re-deploying one of the keycaps as a power button, the number of operational components can be reduced by at least eliminating the switch mechanism associated with the conventional power button and replacing it with the already available keycap assembly and associated circuitry.

In addition to the keyboard, the portable computing device can include a touch sensitive device along the lines of a touch pad, touch screen, etc. In those embodiments where the portable computing device includes a touch pad the touch pad can be formed from a glass material. The glass material provides a cosmetic surface and is the primary source of structural rigidity for the touchpad. The use of the glass material in this way significantly reduces the overall thickness of the touchpad compared to previous designs. The touchpad can include circuitry for processing signals from a sensor associated with the touchpad. In one embodiment, the circuitry can be embodied as a printed circuit board (PCB). The PCB can be formed of material and placed in such a way that it provides structural support for the touchpad. Thus, a separate touchpad support is eliminated.

In one embodiment, the top case can be formed from a single billet of aluminum that is machined into a desired shape and size. The top case can include an integrated support system that adds to the structural integrity of the top case. The integrated support system can be continuous in nature in that there are no gaps or breaks. The integrated support system can be used to provide support for individual components (such as a keyboard). For example, the integrated support system can take the form of ribs that can be used as a reference datum for a keyboard. The ribs can also provide additional structural support due to the added thickness of the ribs. The ribs can also be used as part of a shield that helps to prevent light leaking from the keyboard as well as act as a Faraday cage that prevents leakage of extraneous electromagnetic radiation.

The continuous nature of the integrated support system can result in a more even distribution of an external load applied to the multi-part housing resulting in a reduced likelihood of warping, or bowing that reduces risk to internal components. The integrated support system can also provide mounting structures for those internal components mounted to the multi-part housing. Such internal components include a mass storage device (that can take the form of a hard disk drive, HDD, or solid state drive, SSD), audio components (audio jack, microphone, speakers, etc.) as well as input/output devices such as a keyboard and touch pad.

These and other embodiments are discussed below with reference to FIGS. 1-4. However, those skilled in the art will readily appreciate that the detailed description given herein with respect to these figures is for explanatory purposes only.

FIG. 1 illustrates a portable computing device 100 in the form of a laptop computer in accordance with an example embodiment of the present disclosure. More particularly, FIG. 1 shows a front facing perspective view of the portable computing device 100 in a closed configuration. As illustrated, the portable computing device 100 may include a housing 102 comprising a base portion 104 and a lid portion 106. In the closed configuration, the lid portion 106 and the base portion 104 form what appears to be a uniform structure having a continuously varying and coherent shape that enhances both the look and feel of the portable computing device 100. In some embodiments portable computing device 100 may include a logo 108 at a rear case 110 of the lid portion 106 of the housing 102. In one embodiment, the logo 108 can be illuminated by light emitted from a display 112 (see, e.g., FIG. 2).

The base portion 104 can be pivotally connected to the lid portion 106 by way of a hinge that may include a clutch assembly in some embodiments. The base portion 104 may include an inset portion 114 suitable for assisting a user in lifting the lid portion 106 by, for example, a finger. Accordingly, the lid portion 106 of the housing 102 can be moved with respect to the base portion 104 of the housing with the aid of the clutch assembly from a closed position (see, e.g., FIG. 1) to an open position (see, e.g., FIG. 2).

Figure 2:
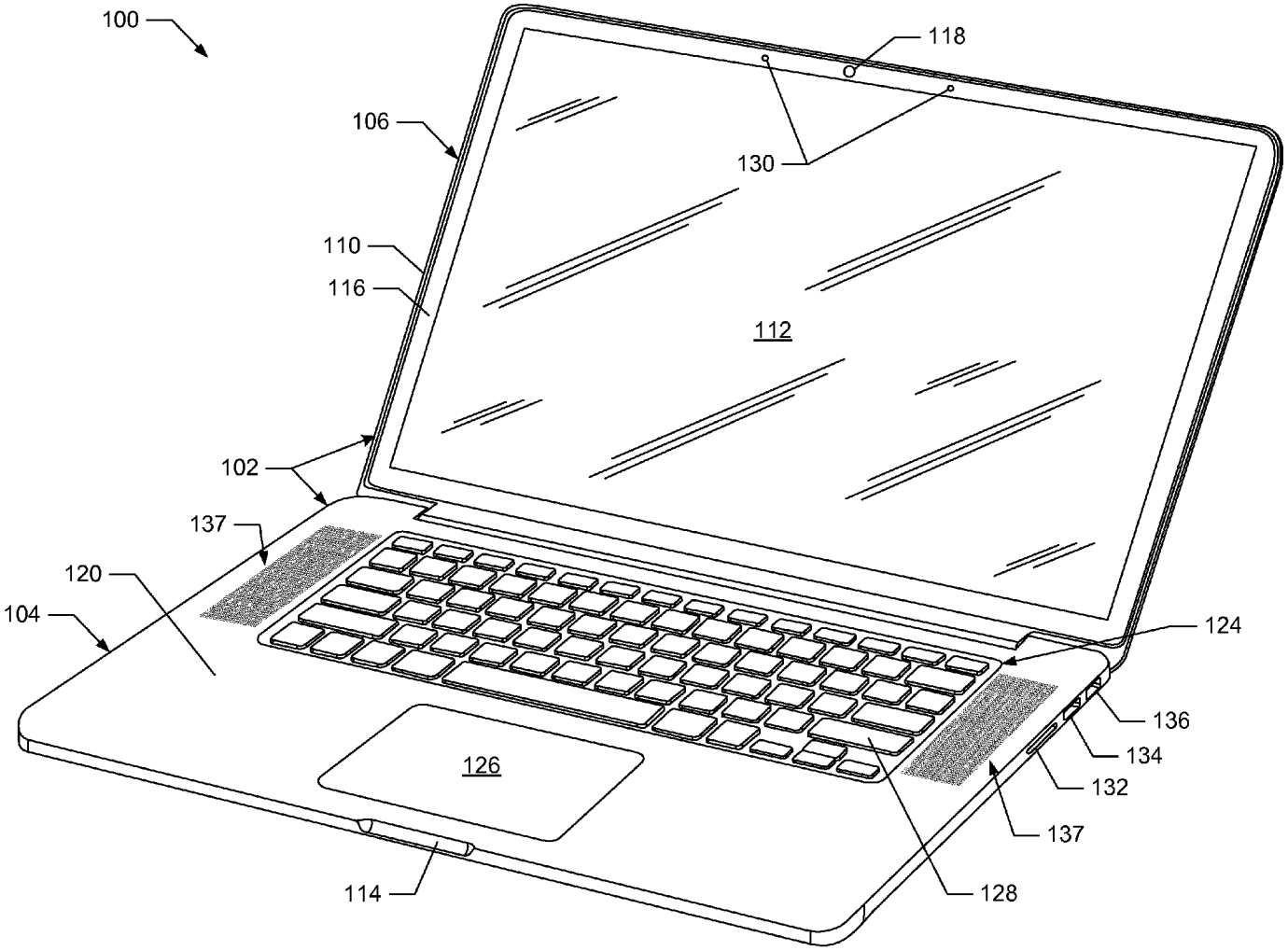
FIG. 2 illustrates the portable computing device of FIG. 1 in an open configuration according to an example embodiment of the present disclosure.

FIG. 2 shows a front facing perspective view of the portable computing device 100 in the open configuration. The display 112 may be coupled to the rear case 110 of the lid portion 106 such that the display is provided with structural support. In this regard, the lid portion 106 can be formed to have uni-body construction provided by the rear case 110 that can provide additional strength and resiliency to the lid portion which is particularly important due to the stresses caused by repeated opening and closing. In addition to the increase in strength and resiliency, the uni-body construction of the lid portion 106 can reduce overall part count by eliminating separate support features, which may decrease manufacturing cost and/or complexity.

The lid portion 106 may include a mask (also referred to as display trim) 116 that surrounds the display 112. The display trim 116 can be formed of an opaque material such as ink deposited on top of or within a protective layer of the display 112. Thus, the display trim 116 can enhance the overall appearance of display 112 by hiding operational and structural components as well as focusing attention onto the active area of the display.

The display 112 can display visual content such as a graphical user interface, still images such as photos as well as video media items such as movies. The display 112 can display images using any appropriate technology such as a liquid crystal display (LCD), a light emitting diode (LED) display, an organic light emitting diode (OLED) display, etc. Further, the portable computing device 100 may include an image capture device 118. In one embodiment the image capturing device 118 may be located on a transparent portion of the display trim 116. The image capture device 118 can be configured to capture both still and video images in some embodiments.

Figure 3:
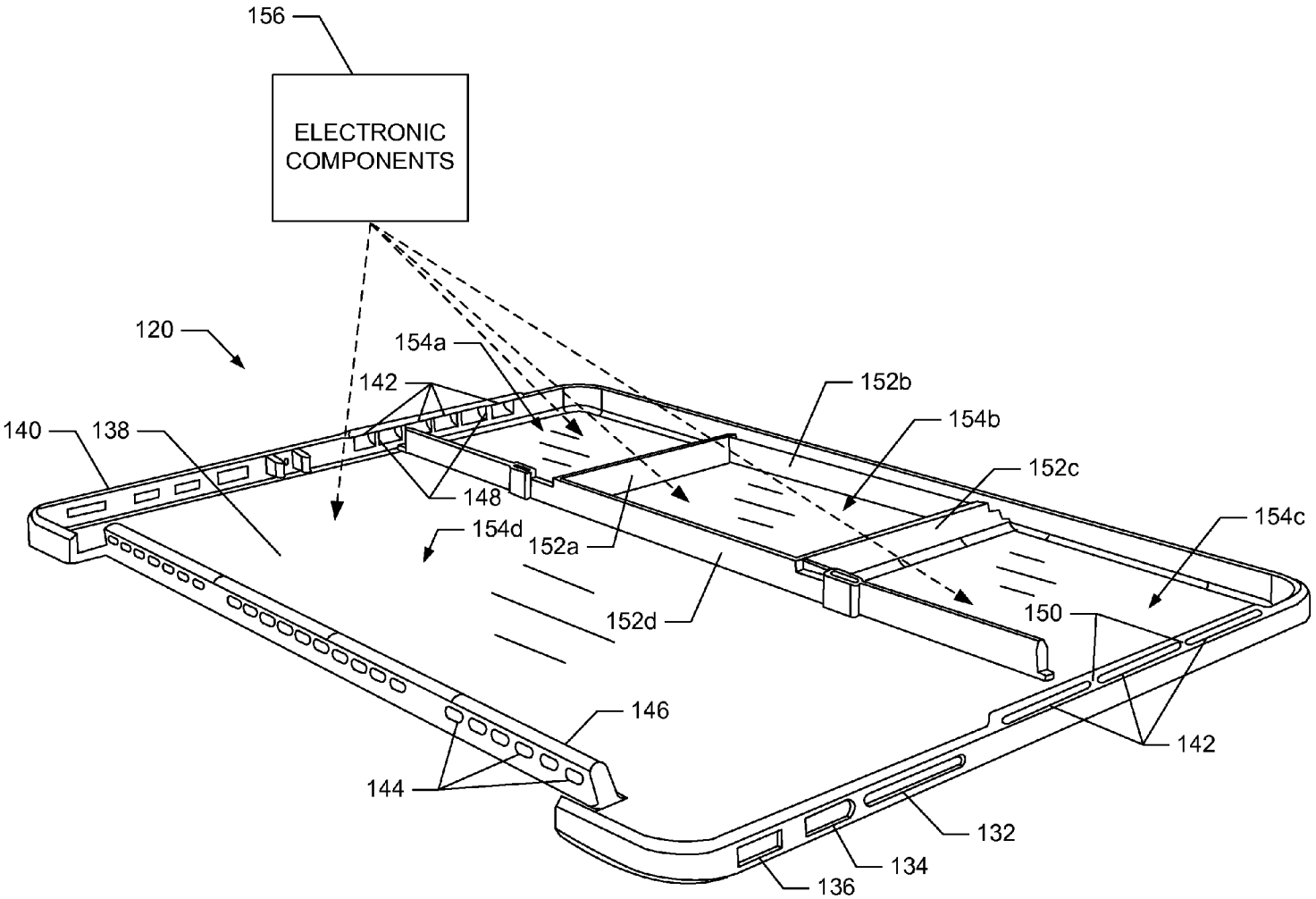
FIG. 3 illustrates a bottom perspective view of a top case of a base portion of the portable computing device of FIG. 1 according to an example embodiment of the present disclosure.
Figure 4:
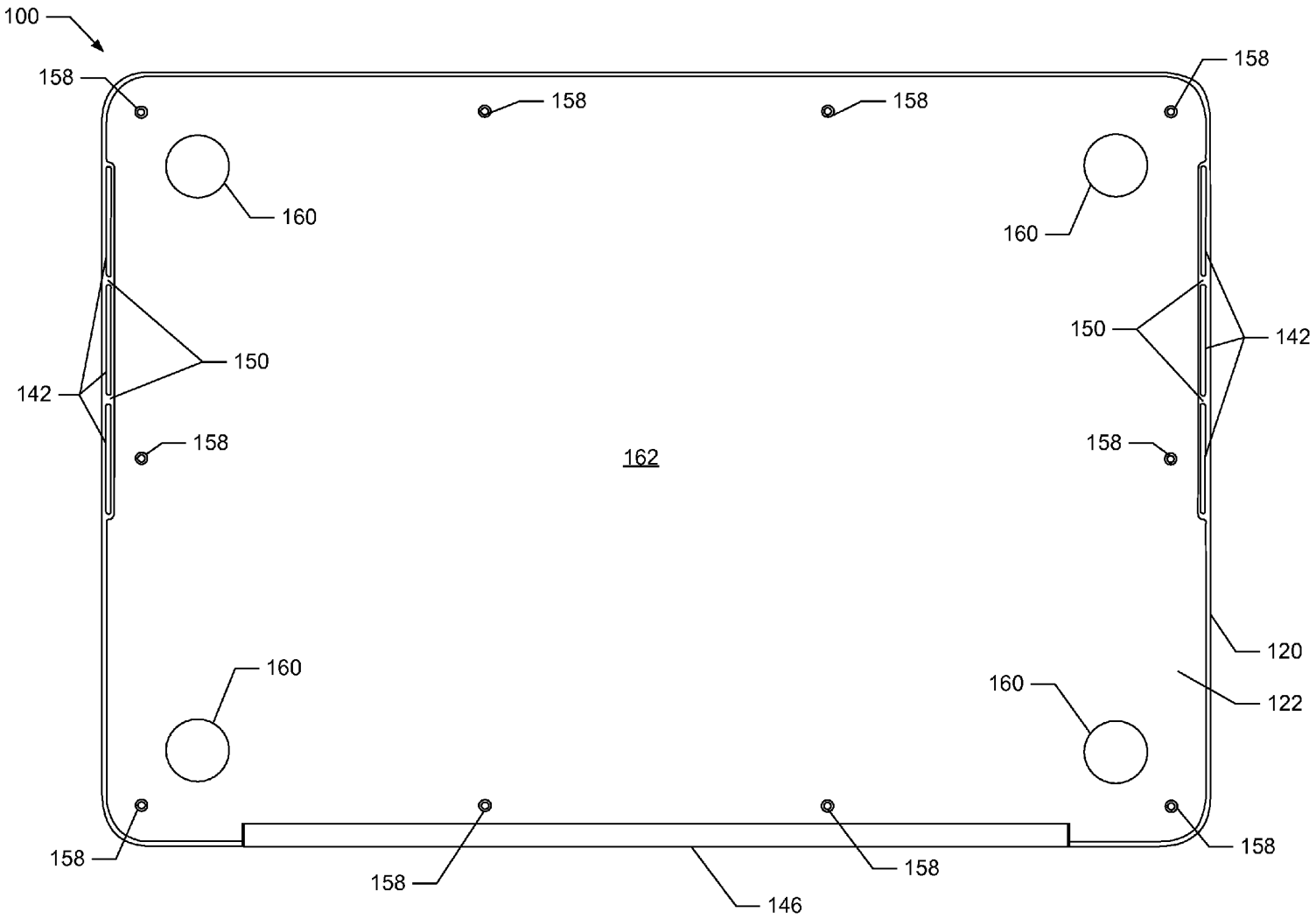
FIG. 4 illustrates a bottom view of the portable computing device of FIG. 1 according to an example embodiment of the present disclosure.

The base portion 104 may comprise a top case 120 (see, e.g., FIG. 3) fastened to a bottom case 122 (see, e.g., FIG. 4). As illustrated in FIG. 2, the top case 120 can be configured to accommodate various user input devices such as a keyboard 124 and a touchpad 126. The keyboard 124 can include a plurality of low profile keycap assemblies 128. In one embodiment, an audio transducer (not shown) can use selected portions of keyboard 124 to control output audio signals such as music. One or more microphones 130 can be located on the lid portion 106. The microphones 130 may be spaced apart to improve frequency response of an associated audio circuit.

Each of the plurality of keycap assemblies 128 can have a symbol imprinted thereon for identifying the key input associated with the particular key pad. The keyboard 124 can be arranged to receive a discrete input at each keycap assembly 128 using a finger motion referred to as a keystroke. In the described embodiment, the symbols on each keycap assembly 128 can be laser etched thereby creating an extremely clean and durable imprint that will not fade under the constant application of keystrokes over the life of portable computing device 100. In order to reduce component count, one of the keycap assemblies 128 can be re-provisioned as a power button. In this way, the overall number of components in the portable computing device 100 can be commensurably reduced.

The touchpad 126 can be configured to receive finger gesturing. A finger gesture can include touch events from more than one finger applied in unison. The gesture can also include a single finger touch event such as a swipe or a tap. The gesture can be sensed by a sensing circuit in the touchpad 126 and converted to electrical signals that are passed to a processing unit for evaluation. In this way, portable computing device 100 can be at least partially controlled by touch.

One or more data ports 132, 134, 136 can be used to transfer data and/or power between an external circuit(s) and the portable computing device 100. The data ports can include, for example, an input slot 132 that can be used to accept a memory card (such as a FLASH memory card), whereas the remaining data ports 134, 136 can be used to accommodate data connections such as USB, FireWire, Thunderbolt, and so on. Further, in some embodiments, one or more speaker grids 137 can be used to output audio from an associated audio component enclosed within base portion 104 of the housing 102.

FIG. 3 illustrates a perspective bottom view of the top case 120 of the base portion 104 of the housing 102. As illustrated, the top case 120 may comprise a major wall 138 and an outer rim 140 extending therefrom. A plurality of vents 142 may be defined in the top case 120. For example, the vents 142 are defined in the outer rim 140 in the illustrated embodiment. The vents 142 may be configured to provide a flow of outside air that can be used to cool internal components by allowing air to enter or exit therethrough. For example, the vents 142 in the outer rim 140 may comprise intake vents and a plurality of vents 144 defined in a rear wall 146 may comprise exhaust vents. In another embodiment the vents 142 in the outer rim 140 can act as a secondary air intake subordinate to primary air intake vents or the vents in the outer rim may comprise exhaust vents.

The vents 142 in the outer rim 140 can also be used to output audio signals in the form of sound generated by an audio module. Accordingly, the vents 142 can be used to output sound at a selected frequency range in order to improve quality of an audio presentation by the portable computing device 100. Additionally, the vents 142 in the outer rim 140 can be part of an integrated support system for the top case 120. In this regard, internal ribs 148 may be positioned within the vents 142 and/or external ribs 150 may be positioned between the vents to provide additional structural support to the portable computing device 100. In some embodiments the vents 142 may be machined from the material defining the top case 120 with the ribs 148, 150 comprising retained material.

The cadence and size of the vents 142 can be used to control air flow into portable computing device 100 as well as control emission of radio frequency (RF) energy in the form of electromagnetic interference (EMI) from the portable computing device. In this regard, the internal ribs 148 can separate an area within the vents 142 to produce an aperture sized to reduce passage of RF energy. The size of an aperture defined by each of the vents 142 may dictate the wavelength of RF energy that can be "trapped" by the aperture. In this case, the size of vents 142 is such that a substantial portion of RF energy emitted by internal components can be trapped within the portable computing device 100. Furthermore, by placing vents 142 at a downward facing outer surface of the top case 120, the aesthetics of portable computing device 100 can be enhanced since views of internal components from an external observer are eliminated during normal use.

As illustrated, the rear wall 146 may extend from the major wall 138. The rear wall 146 may be configured to hide the clutch at the hinge between the base portion 104 and the lid portion 106 of the housing 102. A plurality of inner sidewalls 152*a-d* may also extend from the major wall 138. The inner sidewalls 152*a-d* may divide an interior space defined by the base portion 104 into a plurality of compartments 154*a-d*.

As schematically illustrated in FIG. 3, the portable computing device 100 may include a plurality of electronic components 156, which may be received in one or more of the compartments 154*a-d*. As may be understood, by way of example, the electronic components 156 may include a mass storage device (e.g., a hard drive or a solid state storage device such as a flash memory device including non-transitory and tangible memory that may be, for example, volatile and/or non-volatile memory) configured to store information, data, files, applications, instructions or the like, a processor (e.g., a microprocessor or controller) configured to control the overall operation of the portable electronic device, a communication interface configured for transmitting and receiving data through, for example, a wired or wireless network such as a local area network (LAN), a metropolitan area network (MAN), and/or a wide area network (WAN), for example, the Internet, a fan, a heat pipe, and one or more batteries. However, various other electronic components may additionally or alternatively be received in the housing 102 of the portable electronic device as may be understood by one having skill in the art.

FIG. 4 shows an external view of the bottom of the bottom case 122 of the base portion 104 of the housing 102. One or more fasteners 158 may be positioned at the bottom case 122 of the base portion 104 of the housing 102. The fasteners 158 may be configured to secure the bottom case 122 to the top case 120 to enclose the above-described electronic components 156.

Additionally, in some embodiments the portable computing device 100 may include one or more bumpers. Bumpers may serve a variety of purposes. In this regard, in the illustrated embodiment the portable computing device 100 includes bumpers in the form of feet 160 coupled to an outer surface 162 of the bottom case 122 of the base portion 104 of the housing 102.

Devices such as the above-described portable computing device 100 may be produced by machining a substrate to define one or more components thereof. For example, computer numerical control (CNC) machining may be employed to form components of the portable computing device 100. By way of more particular example, a CNC mill may be employed to form components of the portable computing device 100.

Figure 5:
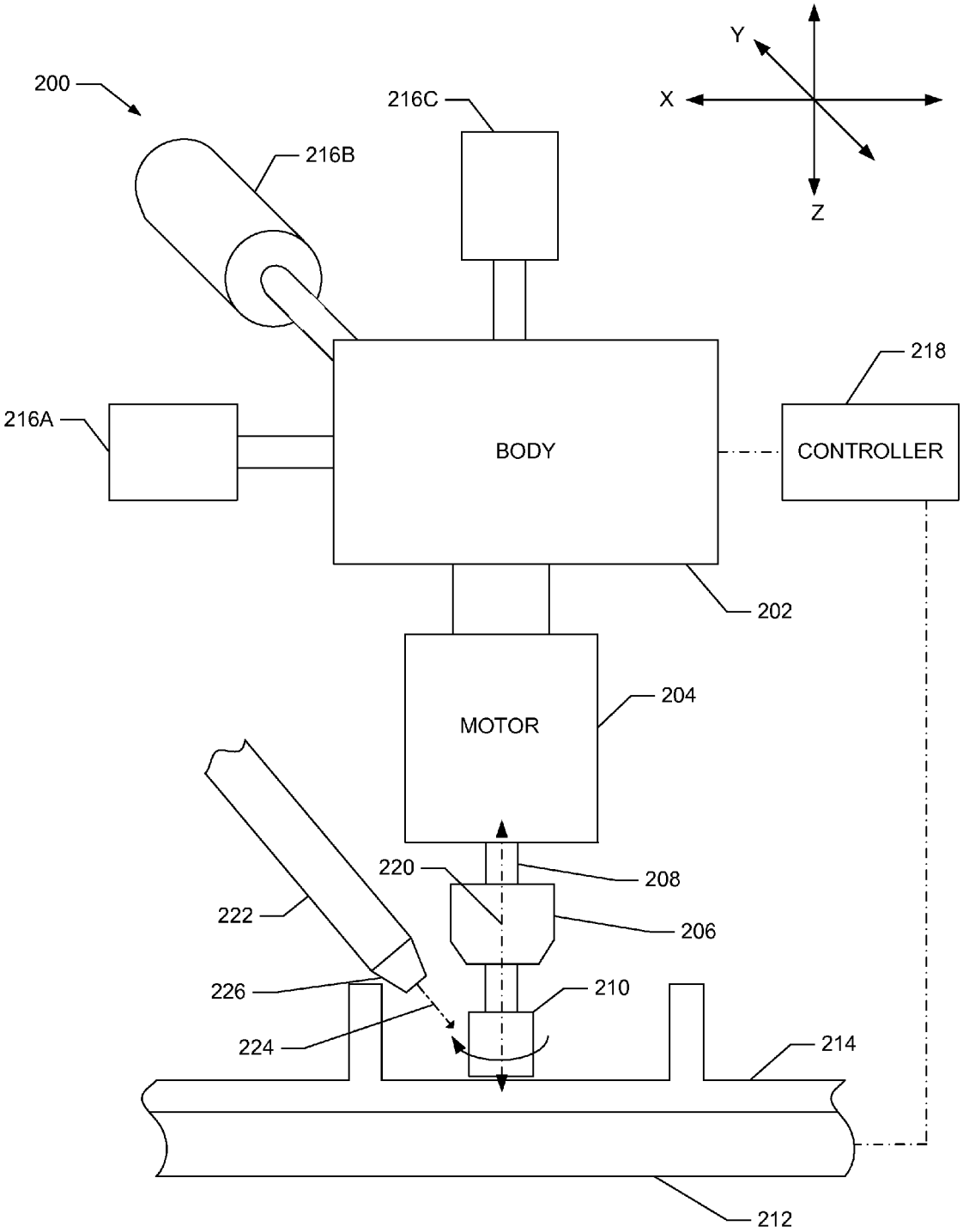
FIG. 5 schematically illustrates a computer numerical control (CNC) mill including a rotary cutter according to an embodiment of the present disclosure.

In this regard, FIG. 5 illustrates an example embodiment of a CNC mill 200 according to an example embodiment of the present disclosure. In one embodiment the CNC mill 200 may comprise a 3-axis vertical mill available from FANUC Corporation of Oshinomura, Japan. However, various other embodiments of CNC mills may be employed in accordance with embodiments of the present disclosure.

As illustrated, the CNC mill 200 may include a machine body 202. The CNC mill 200 may further comprise a motor 204 configured to rotate a rotary head 206 coupled thereto via a spindle 208. The rotary head 206, or "tool holder," may couple to a rotary tool 210 such as any of various milling cutters. A machining table 212 may be configured to support a workpiece or substrate 214. The machining table 212 may be stationary or configured to move in one or more directions.

Additionally, the machine body 202 or an arm or other member extending therefrom may be configured to move. In this regard, the CNC mill 200 may further comprise actuators 216A-C. In the illustrated embodiment the actuators 216 A-C are configured to move the machine body 202 and, therefore, the spindle 208, rotary head 206, and the rotary tool 210 due to coupling therewith. More particularly, a first actuator 216A is configured to move the machine body 202 along an X-axis, a second actuator 216B is configured to move the machine body along a Y-axis, and a third actuator 216C is configured to move the machine body along a Z-axis. Various embodiments of actuators may be employed such as hydraulic or pneumatic actuators.

Further, the CNC mill 200 may include a controller 218. The controller 218 may direct the motor 204 to rotate, which may in turn rotate the spindle 208, the rotary head 206, and the rotary tool 210 coupled thereto about an axis 220. Further, the controller 218 may direct movement of the rotary tool 210 relative to the substrate 214. For example, the machining table 212 may move the substrate 214 or the actuators 216A-C may move the body 202 and/or other portion of the CNC mill 200 to move the rotary tool 210 relative to the substrate.

The CNC mill 200 may additionally include a flood coolant system 222. The flood coolant system 222 may be configured to direct a flow of a coolant 224 (e.g., water and/or oil) proximate the rotary tool 210 and/or the substrate 214 to cool, protect, and/or lubricate the rotary tool and/or the substrate. For example, the flood coolant system 222 may include an external nozzle 226 configured to direct the coolant 224 toward the rotary tool 210 and/or the substrate 210.

Accordingly, the CNC mill 200 may remove material from the substrate 214 to form a component. For example, the substrate 214 may be machined to form the above-described top case 120 of the base portion 104 of the housing 102. However, depending on the characteristics of the cutting tool 210 and the desired shape of the component, the cutting tool may be incapable of removing material from the substrate 214 with a desired level of precision. Further, it may be desirable to remove sharp corners or other features from the substrate 214 following machining or provide the substrate with a desired surface finish. Accordingly, for these and various other reasons, it may be desirable to perform finishing operations on the substrate 214.

For example, such finishing operations may include sanding. Sanding may be conducted by rotating an abrasive disk against the substrate 214. However abrasive disks may not be configured to, or capable of, conforming to complex geometries of the substrate. For example, it may be difficult to sand the curved spline of a tablet computer or the above-described laptop computer using an abrasive disk.

Figure 6:
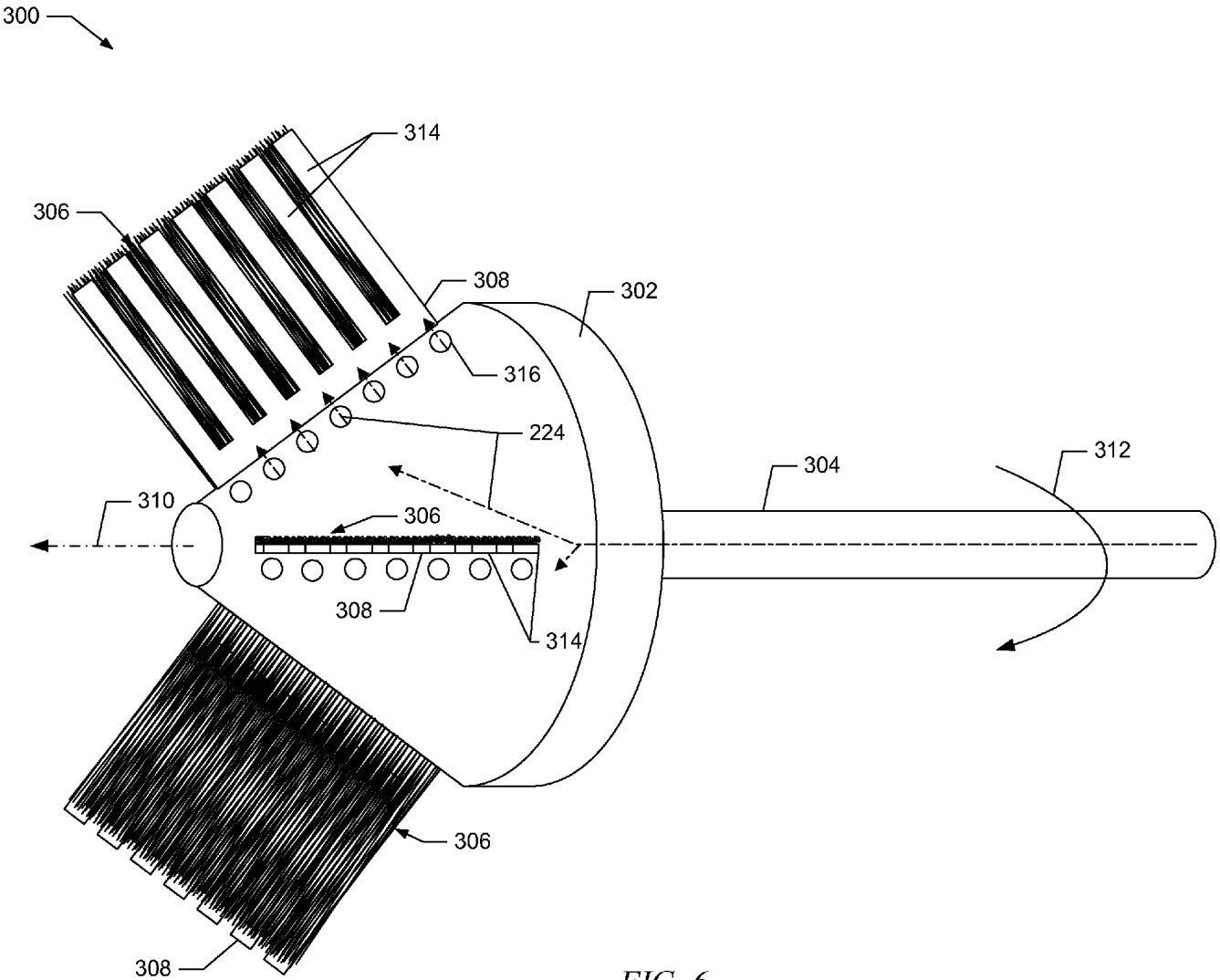
FIG. 6 illustrates a perspective view of a rotary tool including a truncated cone shaped rotary head according to an embodiment of the present disclosure.

Accordingly, embodiments of the present disclosure provide rotary tools configured to sand, abrade, or otherwise preform finishing operations on substrates and components including substrates and components defining complex geometries. In this regard, FIG. 6 illustrates a rotary tool 300 according to an embodiment of the disclosure, which may be rotated using a CNC mill. As illustrated, the rotary tool 300 may include a tool head 302 coupled to a shaft 304. A plurality of bristles 306 and an abrasive material 308 may be coupled to the tool head 302. The bristles 306 and the abrasive material 308 may be water resistant (e.g., water proof) and configured to conform to a shape of a component undergoing finishing during rotation of the tool head 302 about a rotational axis 310 to affect a surface finish of the component (e.g., by abrading, sanding, or otherwise affecting a surface finish of the component).

The bristles 306 may comprise a plurality of polymer filaments (e.g., nylon) and the abrasive material 308 may comprise sandpaper (e.g., water resistant or water proof sandpaper) in some embodiments. As illustrated, the bristles 306 and the abrasive material 308 may extend radially from a rotational axis 310 of the tool head 302 and the shaft 304. The bristles 306 may be coupled to a back of the abrasive material 308 in terms of a preferred rotational direction 312 thereof. Accordingly, the bristles 306 may clear particles from the component undergoing finishing that are removed from the component by the abrasive material 308. Further, the abrasive material 308 may comprise a plurality of tabs 314, which may extend substantially parallel to the bristles 306. The tabs 314 and the bristles 306 may thus individually articulate such that the rotary tool 300 may conform to the shape of the component being finished. Thereby, the rotary tool 300 may provide greater flexibility in terms of the shape of the components that may be finished, such that complex geometries thereof may be accommodated.

Figure 7:
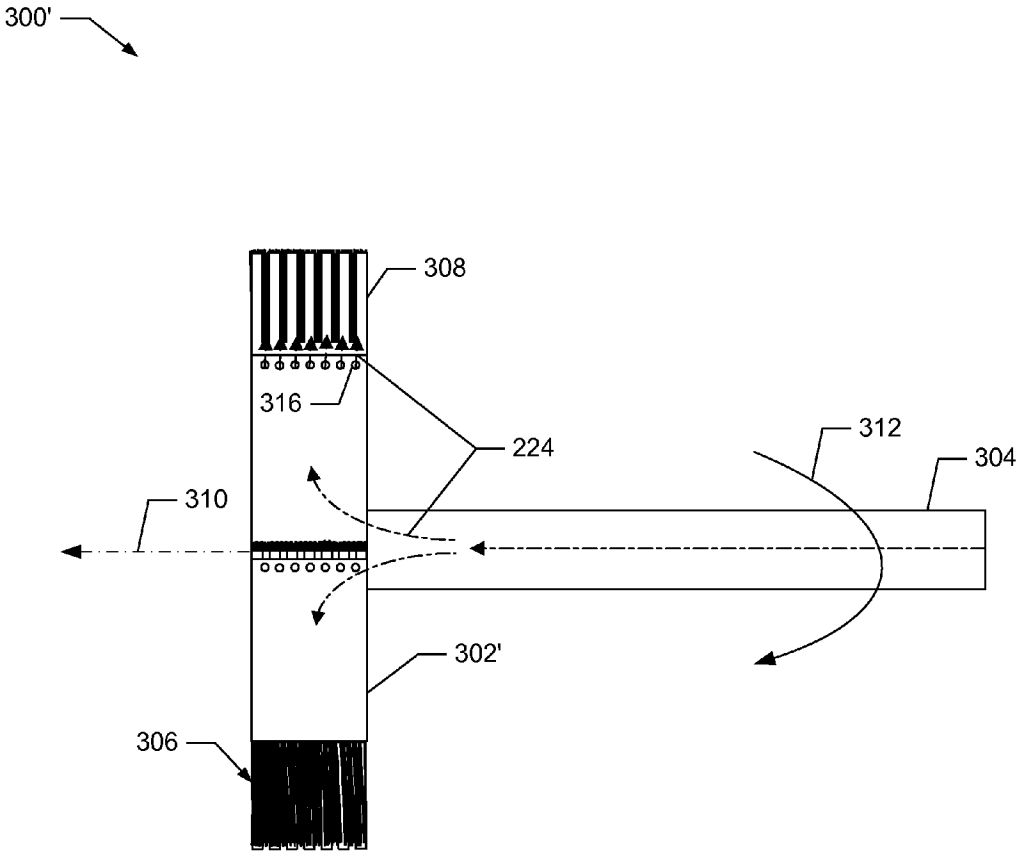
FIG. 7 illustrates a side view of a rotary tool including a cylinder shaped rotary head and bristles and abrasive material extending radially therefrom according to an embodiment of the present disclosure.
Figure 8:
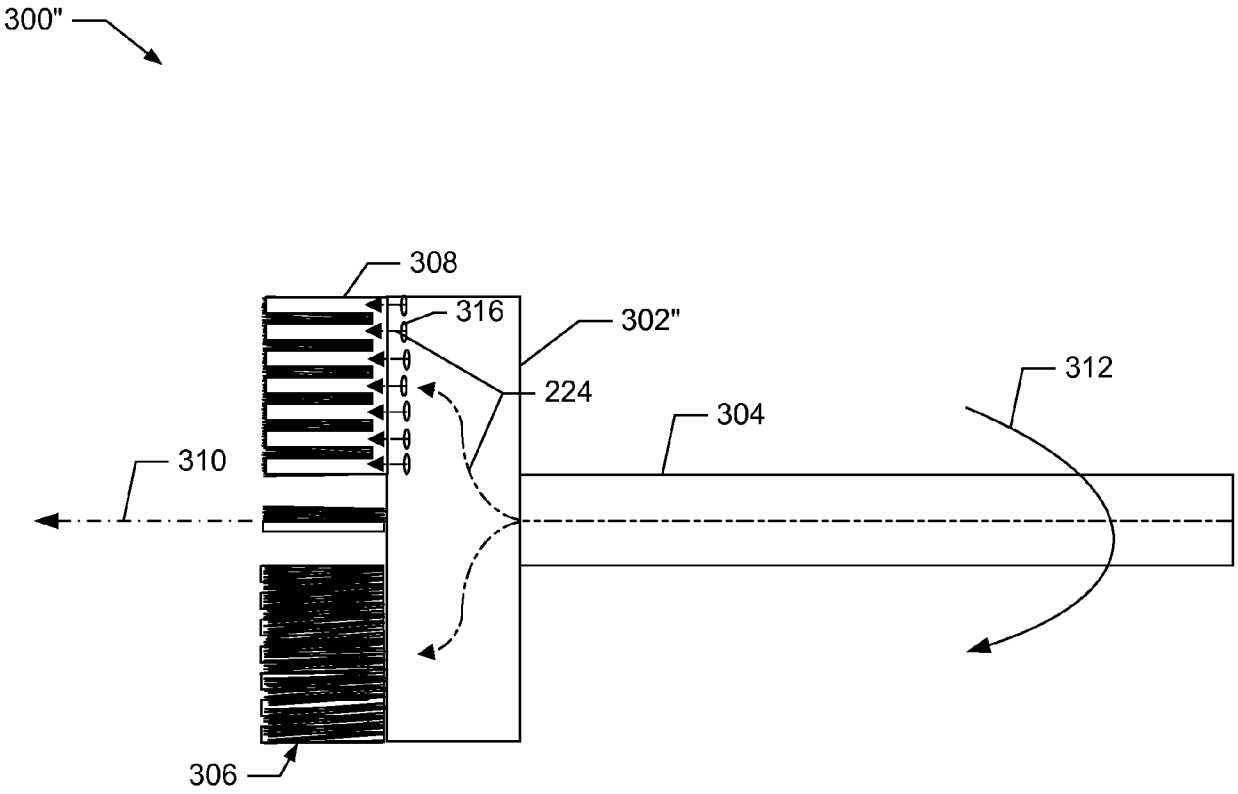
FIG. 8 illustrates a side view of a rotary tool including a cylinder shaped rotary head and bristles and abrasive material extending from an end thereof according to an embodiment of the present disclosure.

In the embodiment of the rotary tool 300 illustrated in FIG. 6, the tool head 302 defines a truncated cone configuration. However, various other configurations may be employed. For example, as illustrated in FIG. 7, in one embodiment of the rotary tool 300' the bristles 306 and the abrasive material 308 may extend radially from a cylindrical tool head 302'. In another embodiment, as illustrated in FIG. 8, the bristles 306 and the abrasive material 308 may extend from an end of a cylindrical tool head 302". Accordingly, various embodiments of the rotary tool may be employed depending on the type and shape of component being subjected to finishing operations.

Rotation of the rotary tool 300 may produce heat as a result of abrading contact with the component undergoing finishing. Accordingly, it may be desirable to employ coolant to cool the rotary tool 300 during use thereof. However, use of a flood coolant system, such as the flood coolant system 222 described above, may insufficiently cool the rotary tool 300. In particular, flood coolant systems may be incapable of directing coolant at the inner most portions of the bristles 306 and the abrasive material 308 due to the bristles and the abrasive material at least partially blocking the coolant from reaching the rotational axis 310 of the rotary tool during rotation thereof. Thus, for example, the bristles 306 closest to the rotational axis 310 may melt, which could contaminate the component being finished and/or shorten the life of the rotary tool 300.

Accordingly, the rotary tools 300 may be cooled via use of a through spindle system. A through spindle system is a cooling system configured to deliver coolant through the spindle employed to rotate the rotary tool. Thus, as illustrated in FIGS. 6-8. the shaft 304 and the rotary head 302 of the rotary tool 300 may be hollow or include channels therein configured to direct a flow of coolant 224 received from a spindle out of the tool head 302 (e.g., through outlets 316) to the bristles 306 and the abrasive material 308.

However, many existing embodiments of CNC mills in use today may include flood coolant systems, rather than through spindle coolant systems. Conversion kits may allow for conversion of CNC mills from flood coolant systems to through spindle coolant systems. However, such systems may be expensive (e.g. exceeding $10,000). Alternatively, coolant inducers may be employed to create a flow of coolant through the tool holder toward a tool. However, such inducers may include ceramic bearings that may be consumable, and such inducers may also be relatively costly.

Figure 9:
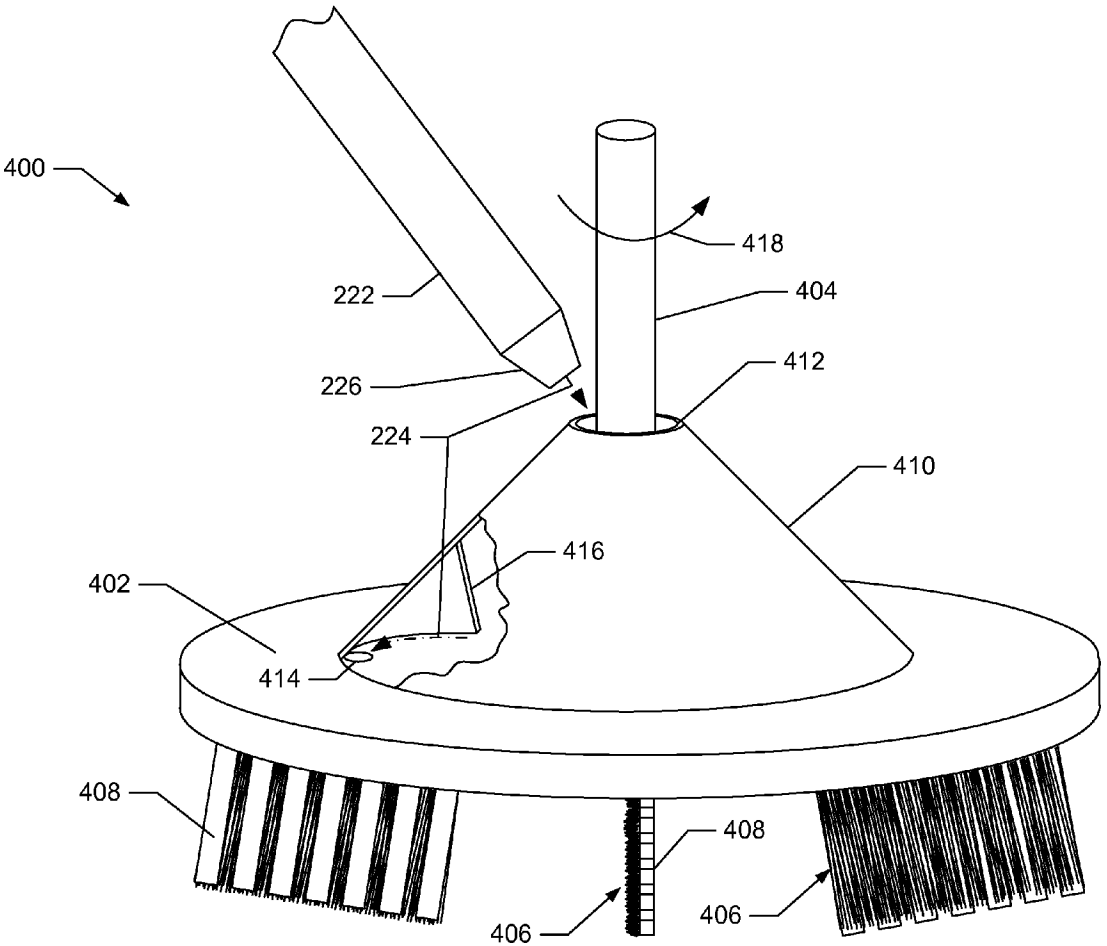
FIG. 9 illustrates a perspective view of a rotary tool including a rotary head and cone configured to receive coolant and direct the coolant through the rotary head according to an embodiment of the present disclosure.

Accordingly, embodiments of the present disclosure include mechanisms configured to facilitate delivery of coolant to rotary tools. In this regard, FIG. 9 illustrates an embodiment of a rotary tool 400 configured to receive coolant 224 sprayed from an external nozzle 226 of a flood coolant system 222. As illustrated, the rotary tool 400 may include a tool head 402 and a shaft 404 coupled to the tool head. Further, as described above, bristles 406 and the abrasive material 408 may extend from the tool head 402. Further, the rotary tool 400 may include a truncated cone 410 coupled to the tool head 402. The cone 410 may define an upper opening 412, through which the shaft 404 extends, and which is configured to receive the coolant 224 sprayed from the external nozzle 226 of the flood coolant system 222 and direct the coolant downwardly through the tool head 402. Thereby, the coolant 224 may exit through one or more outlets 414 defined through the tool head 402 to cool, lubricate, and protect the bristles 406 and/or the abrasive material 408. In some embodiments one or more scoops 416 inside the cone 410 may direct the coolant 224 through the outlets 414. In this regard, as the rotary tool 400 rotates in a rotational direction 418, centripetal force may direct the coolant down the length of the cone and radially outward. The scoops 416 may thereby impact the coolant 224 and direct the coolant through the outlets 414. However, even if the scoops 416 are not employed, centripetal force may direct the coolant 224 out through the outlets 414 due to the increasing diameter of the cone 410 at the bottom thereof.

Figure 10:
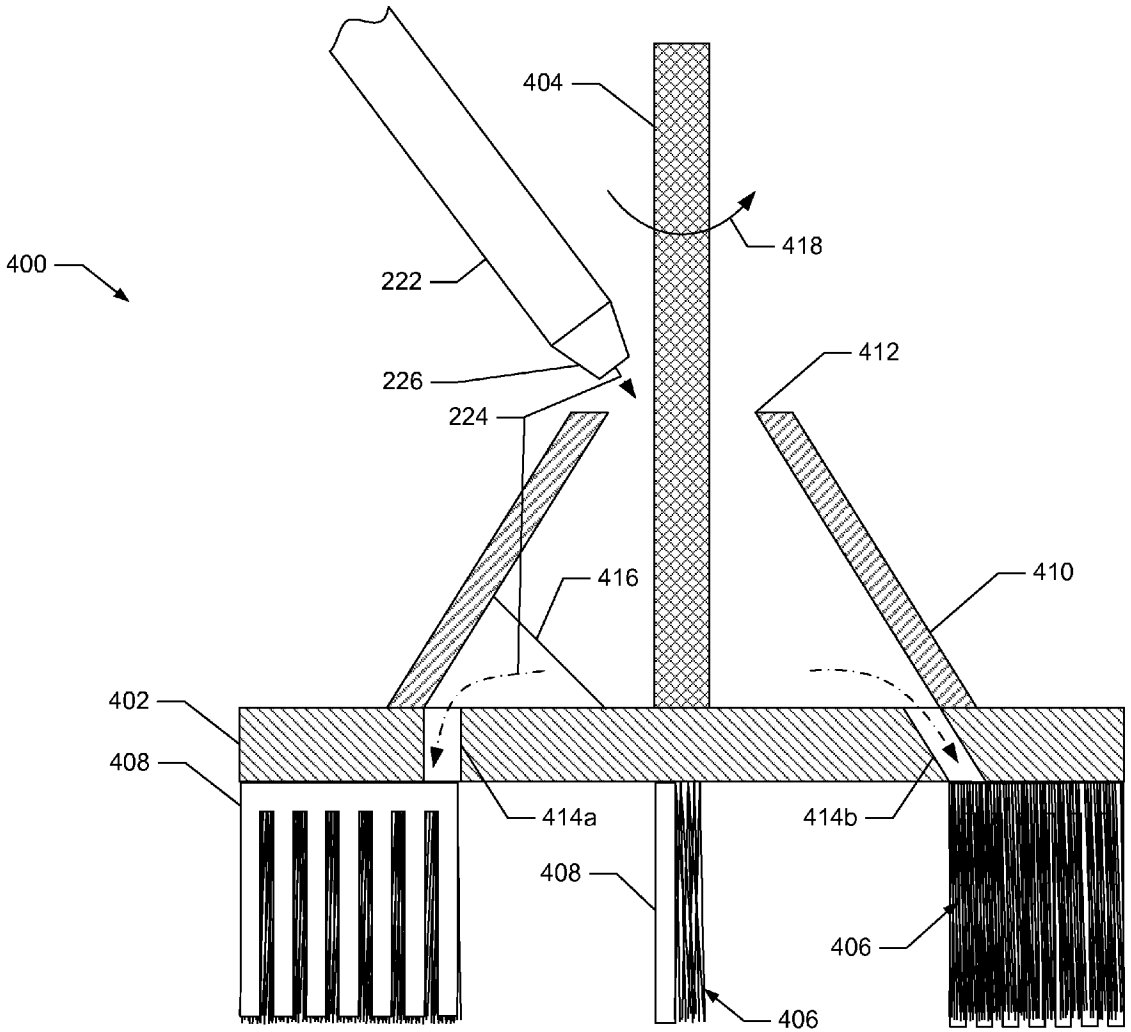
FIG. 10 illustrates a sectional view through the rotary tool of FIG. 9.

FIG. 10 illustrates a sectional view through the tool 400. As illustrated, the particular configuration of the outlets 414 may vary. For example, an outlet 414*a* may extend perpendicularly to an outer and/or inner surface of the tool head 402. Alternatively, an outlet 414*b* may extend substantially parallel to an inner surface of the cone 410, which may facilitate flow of the coolant 224 therethrough by providing a substantially straight flow path.

However, the rotary tool 400 may be limited in that the shaft 404 must be sufficiently small relative to the diameter of the opening 412 to the cone 410 to allow the coolant 224 to flow therebetween. Accordingly, the overall size of the rotary tool 400 must be relatively large, or the shaft 404 must be relatively small in order to provide a sufficiently large gap between the cone 410 and the shaft at the opening 412 to accommodate receipt of coolant therethrough. However, in some instances a relatively small rotary tool may be desired or required. Further, depending on the rotational speed of the rotary tool 404 and other factors impacting the forces applied to the rotary tool, the diameter of the shaft may only be reduced to a certain extent.

Figure 11:
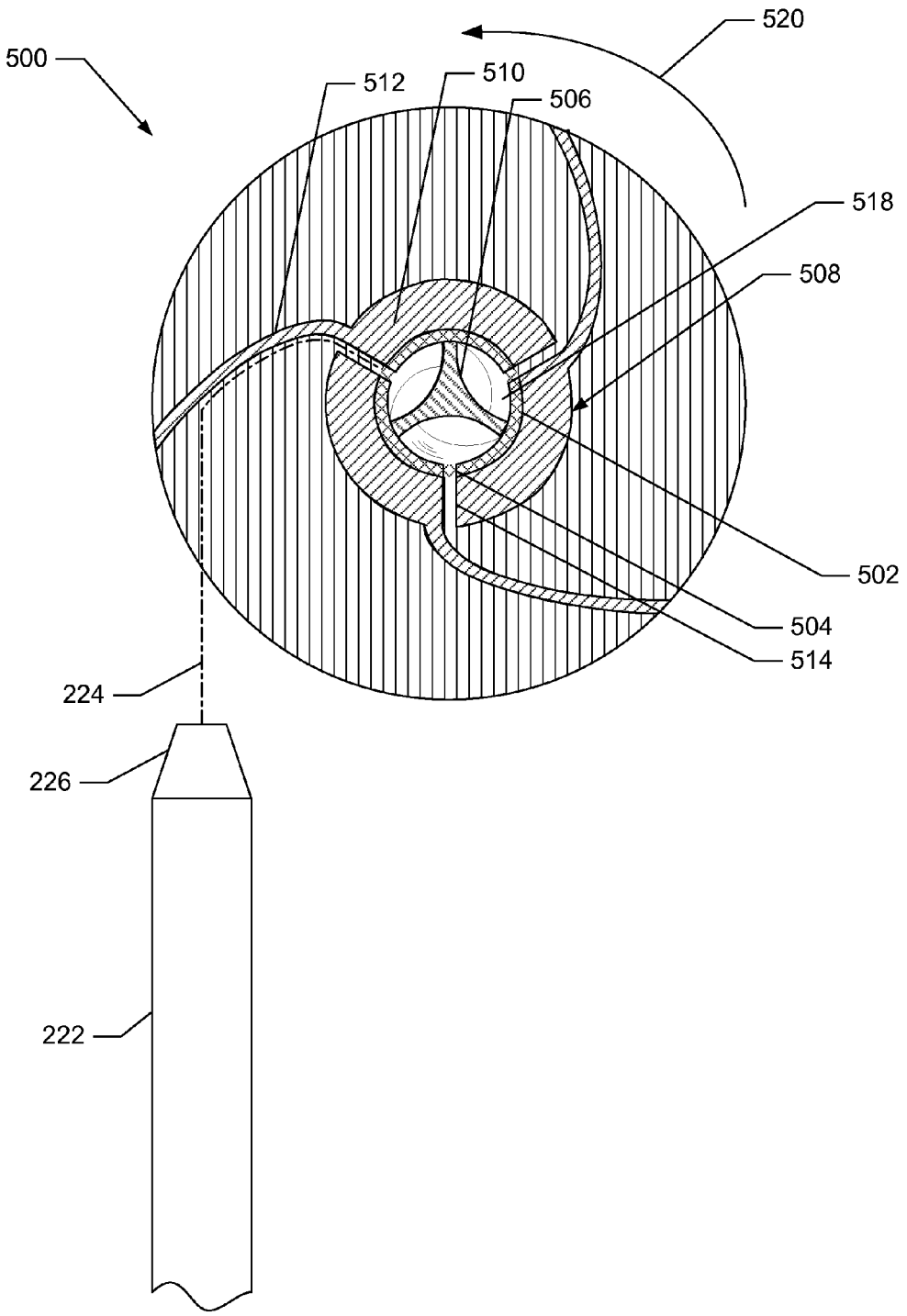
FIG. 11 illustrates a sectional view through a system configured to convert a flood coolant system to a through spindle coolant system according to an example embodiment of the present disclosure.

Additional embodiments of the present disclosure are configured to avoid the above-mentioned problems. Accordingly, systems configured to convert a flood coolant system to a through spindle coolant system are provided herein. In this regard, FIG. 11 illustrates a sectional view through an embodiment of a conversion apparatus 500 configured to convert a flood coolant system to a through spindle coolant system. As illustrated, the conversion apparatus 500 may include a hollow shaft 502 defining a plurality of inlets 504 configured to receive a coolant sprayed from an external nozzle therethrough. Further, the conversion apparatus 500 may include a redirector 506 positioned within the hollow shaft 504 and configured to direct the coolant 224 through the hollow shaft. In this regard, the redirector 506 may include angled surfaces that direct the flow downward through the hollow shaft 504.

Figure 12:
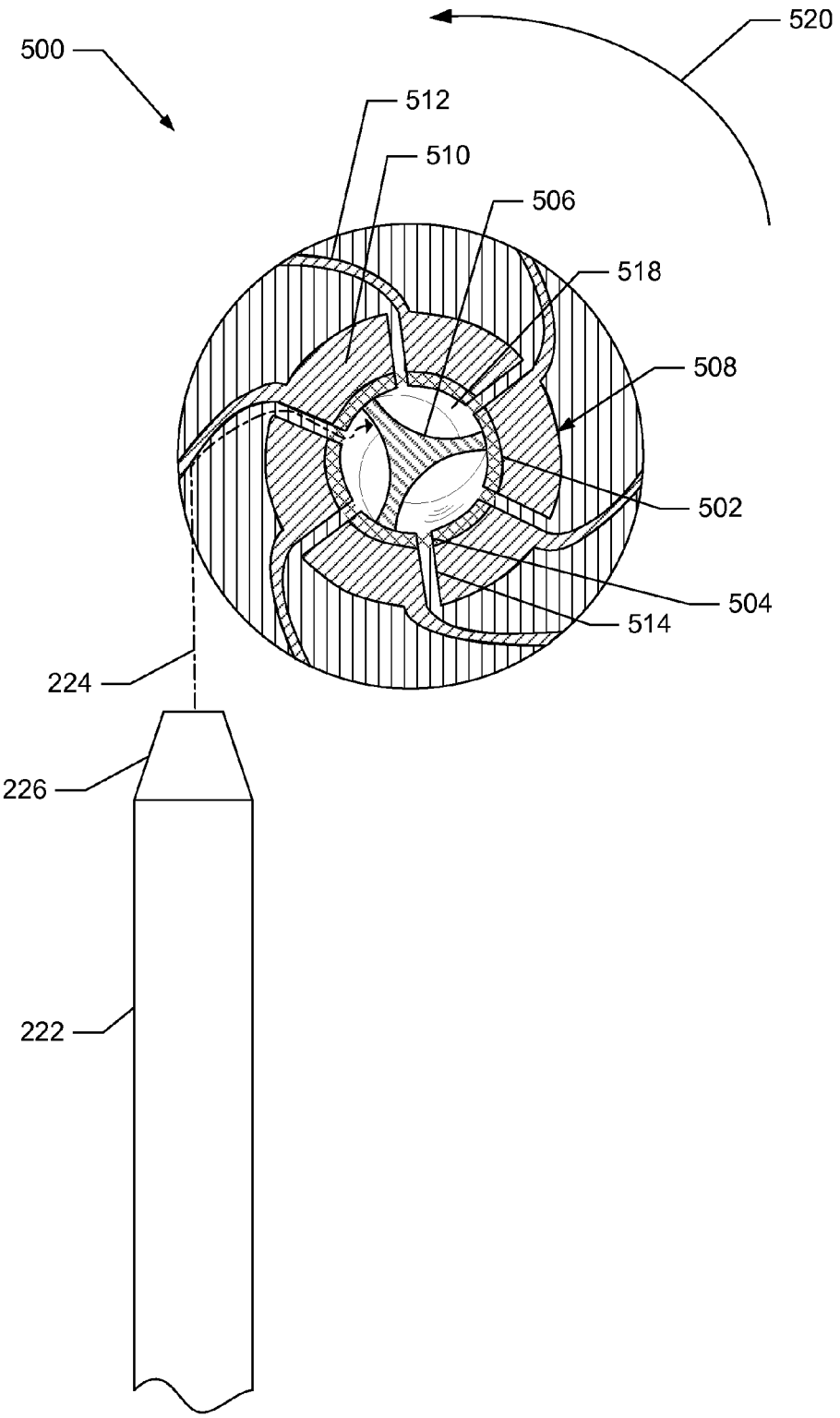
FIG. 12 illustrates a sectional view through the system of FIG. 11 including a greater number of relatively shorter scoops according to an example embodiment of the present disclosure.

The conversion apparatus 500 may further comprise a flow receptor wheel 508 coupled to the hollow shaft 502. The flow receptor wheel 508 may include a body portion 510. A plurality of scoops 512 (e.g., curved scoops) may extend from the body portion 510. Further, a plurality of apertures 514 may be defined in the body portion 510. The scoops 512 may thus be configured to receive coolant 224 sprayed from an external nozzle 226 of the flood coolant system 222 and direct the coolant through the apertures 514 in the body portion 510 of the flow receptor wheel 508 into the inlets 504 in the hollow shaft 502. Note that although the flow receptor wheel 508 is illustrated as including a relative small number of scoops 512 have a relatively long length in FIG. 11, various other configurations may be employed. For example, FIG. 12 illustrates an embodiment of the conversion apparatus 500 including a relatively larger number of the scoops 512 which respectively define a relatively smaller length. Use of a greater number of scoops 512 defining a relatively shorter length may facilitate capturing more of the coolant 224 sprayed from the external nozzle 226 of the flood coolant system 222 by reducing the gap between each of the scoops.

Figure 13:
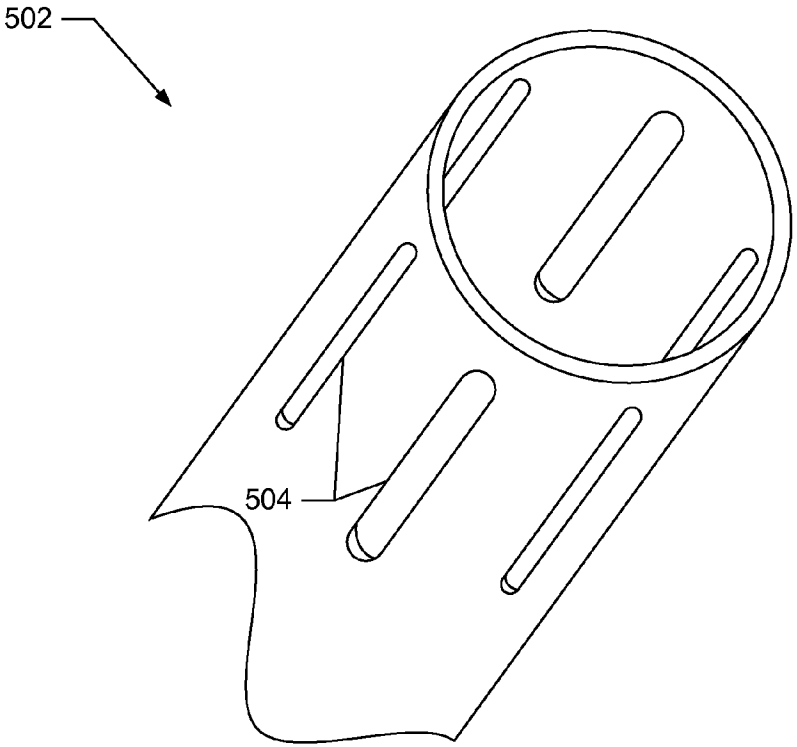
FIG. 13 illustrates a perspective view of a hollow shaft of the system of FIG. 11 according to an example embodiment of the present disclosure.
Figure 14:
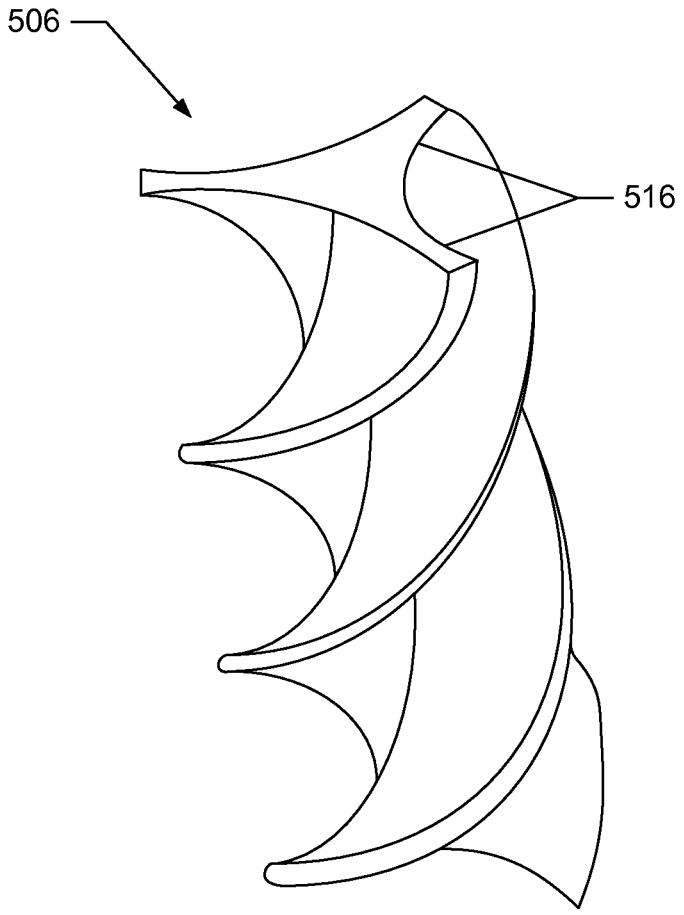
FIG. 14 illustrates a redirector of the system of FIG. 11 according to an example embodiment of the present disclosure.

A partial perspective view of an example embodiment of the hollow shaft 502 of the conversion apparatus 500 is illustrated in FIG. 13. More particularly, FIG. 13 illustrates an end of the hollow shaft 502 including the inlets 504. Further, FIG. 14 illustrates an example embodiment of the redirector 506 configured to be received in the hollow shaft 502. As illustrated, in one embodiment the redirector 506 may define a plurality of flanges 516. Further, the redirector may define a spiral, corkscrew, or helical configuration. Accordingly, as illustrated in FIGS. 11 and 12, the redirector 506 may cooperate with the hollow shaft 502 to define a plurality of spiral shaped channels 518, each of the spiral shaped channels being in communication with at least one of the inlets 504 in the hollow shaft. For example, an equal number of inlets 504 and spiral shaped channels 518 may be provided in some embodiments, as illustrated in FIG. 11. Alternatively, in some embodiments multiple inlets 504 may be associated with a respective spiral shaped channel 518, as illustrated in FIG. 12.

Note that, as illustrated in FIGS. 11 and 12, the external nozzle 226 of the flood coolant system 222 may be configured to direct the coolant 224 substantially tangentially to the flow receptor wheel 508. Further, the flow receptor wheel 508 and the hollow shaft 502 may rotate in a rotational direction 520 configured to direct the scoops 512 substantially toward the external nozzle 226 at the location at which the coolant 224 contacts the scoops. Accordingly, the scoops may receive the coolant 224 and direct the coolant into the hollow shaft 502.

Figure 15:
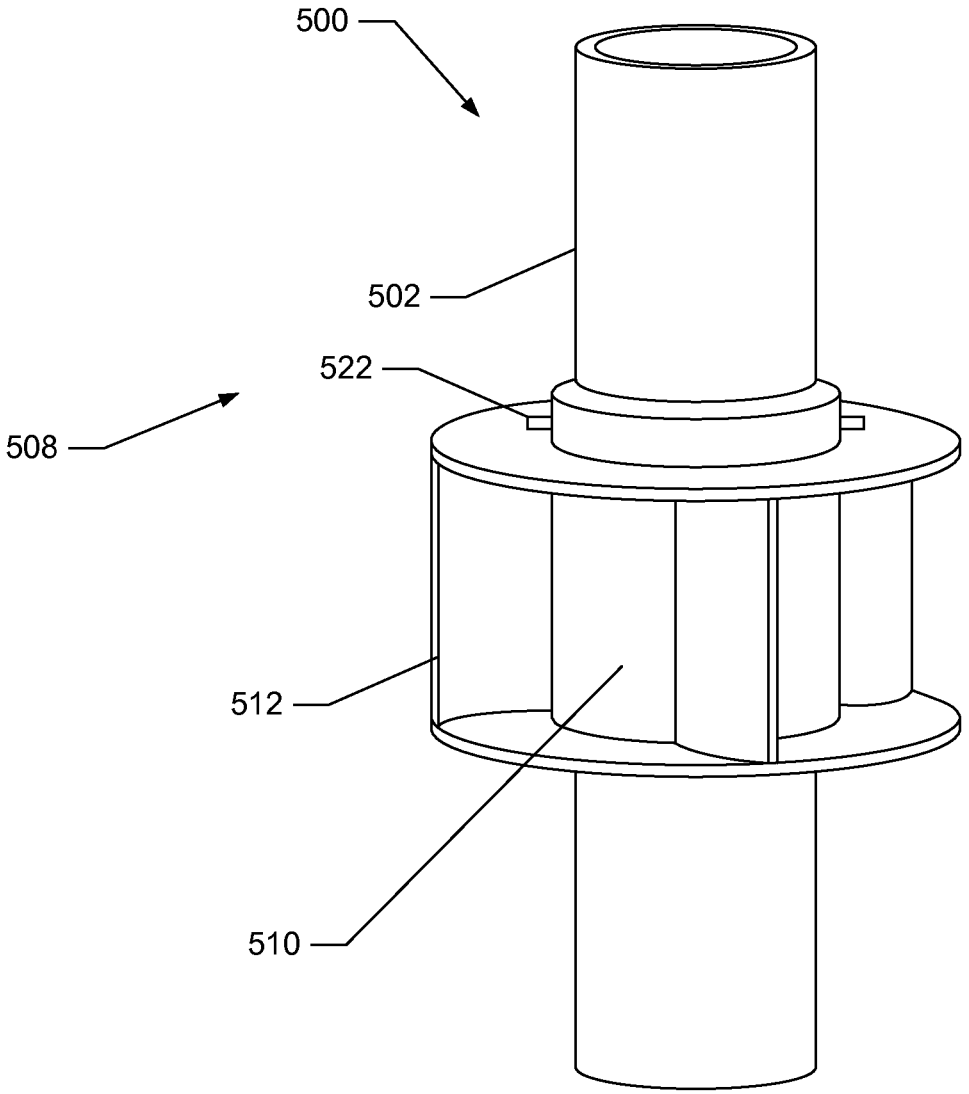
FIG. 15 illustrates a perspective view of the system of FIG. 11 wherein the hollow shaft thereof is configured to engage a tool holder according to an example embodiment of the present disclosure.

The conversion apparatus 500 may define multiple forms. For example, FIG. 15 illustrates an embodiment of the conversion apparatus 500 in which the hollow shaft 502 is configured to engage a tool holder of a CNC mill (see, e.g., tool holder 206 of CNC mill 200 in FIG. 5). Accordingly, the conversion apparatus 500 may attach to a conventional tool holder to convert the CNC mill to a through spindle coolant system. Thus, for example, the hollow shaft 502 may comprise the shaft of a rotary tool (see, e.g., the rotary tools illustrated in FIGS. 6-8). Thereby, for example, a tool head may be coupled to the hollow shaft to form the rotary tool and the coolant 224 may be delivered thereto.

Figure 16:
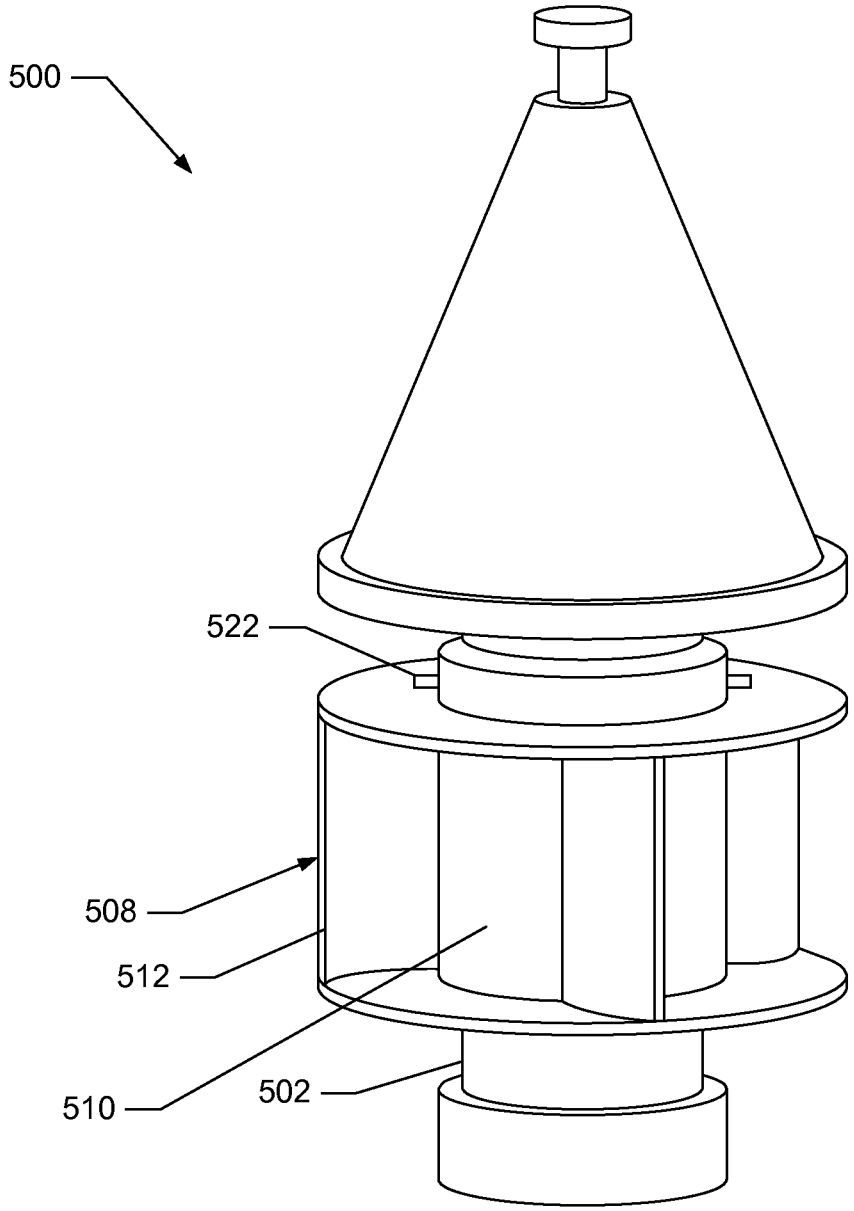
FIG. 16 illustrates a perspective view of the system of FIG. 11 wherein the hollow shaft thereof comprises a tool holder configured to engage a rotary tool according to an example embodiment of the present disclosure.

Alternatively, as illustrated in FIG. 16, the hollow shaft 502 may comprise a tool holder configured to engage a rotary tool. Accordingly, in some embodiments the conversion apparatus 500 may define a tool holder which may replace a conventional tool holder of a CNC mill (see, e.g., tool holder 206 of CNC mill 200 in FIG. 5) to convert the CNC mill to a through spindle coolant system. Thereby, for example, the conversion apparatus 500 may engage the shaft of a rotary tool (see, e.g., the rotary tools illustrated in FIGS. 6-8) to deliver the coolant 224 thereto.

Note that, regardless of the particular embodiment of the conversion apparatus 500 employed, the flow receptor wheel 508 may be rotationally coupled to the hollow shaft 502. In this regard, a pin 522 may couple the flow receptor wheel 508 to the hollow shaft 502, as illustrated in FIGS. 15 and 16. However, the flow receptor wheel 508 may be rotationally coupled to the hollow shaft in various other manners.

Figure 17:
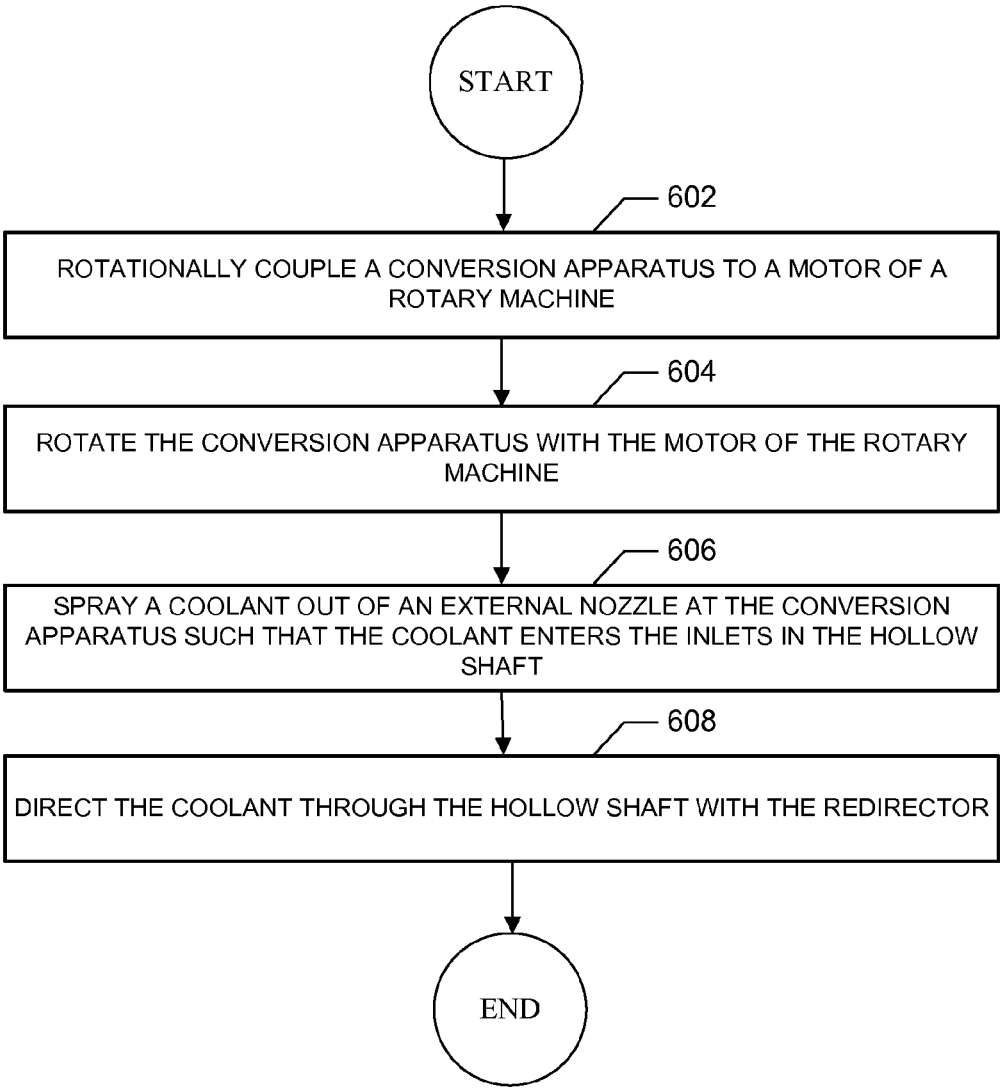
FIG. 17 schematically illustrates a method for converting a flood coolant system to a through spindle coolant system according to an example embodiment of the present disclosure.

A method for converting a flood coolant system to a through spindle coolant system is also provided. As illustrated in FIG. 17, the method may include rotationally coupling a conversion apparatus to a motor of a rotary machine at operation 602. The conversion apparatus may include a hollow shaft defining a plurality of inlets and a redirector positioned within the hollow shaft. Further, the method may include rotating the conversion apparatus with the motor of the rotary machine at operation 604. Additionally, the method may include spraying a coolant out of an external nozzle at the conversion apparatus such that the coolant enters the inlets in the hollow shaft at operation 606. The method may also include directing the coolant through the hollow shaft with the redirector at operation 608.

In some embodiments spraying the coolant out of the external nozzle at the conversion apparatus at operation 606 comprises spraying the coolant at a flow receptor wheel coupled to the hollow shaft, the flow receptor wheel comprising a plurality of the scoops configured to receive the coolant sprayed from the external nozzle and direct the coolant through a plurality of apertures defined in the body portion into the inlets in the hollow shaft. Further, directing the coolant through the hollow shaft at operation 608 may comprise directing the coolant through a plurality of spiral shaped channels defined between the redirector and the hollow shaft. The method may additionally include engaging the hollow shaft with a rotary tool or engaging the hollow shaft with a tool holder. The method may further comprise coupling a rotary tool to the shaft, wherein the rotary tool comprises a tool head with a plurality of bristles and an abrasive material coupled thereto, and directing the coolant from the shaft out of the tool head through a plurality of outlets extending therethrough to the bristles and the abrasive material.

Figure 18:
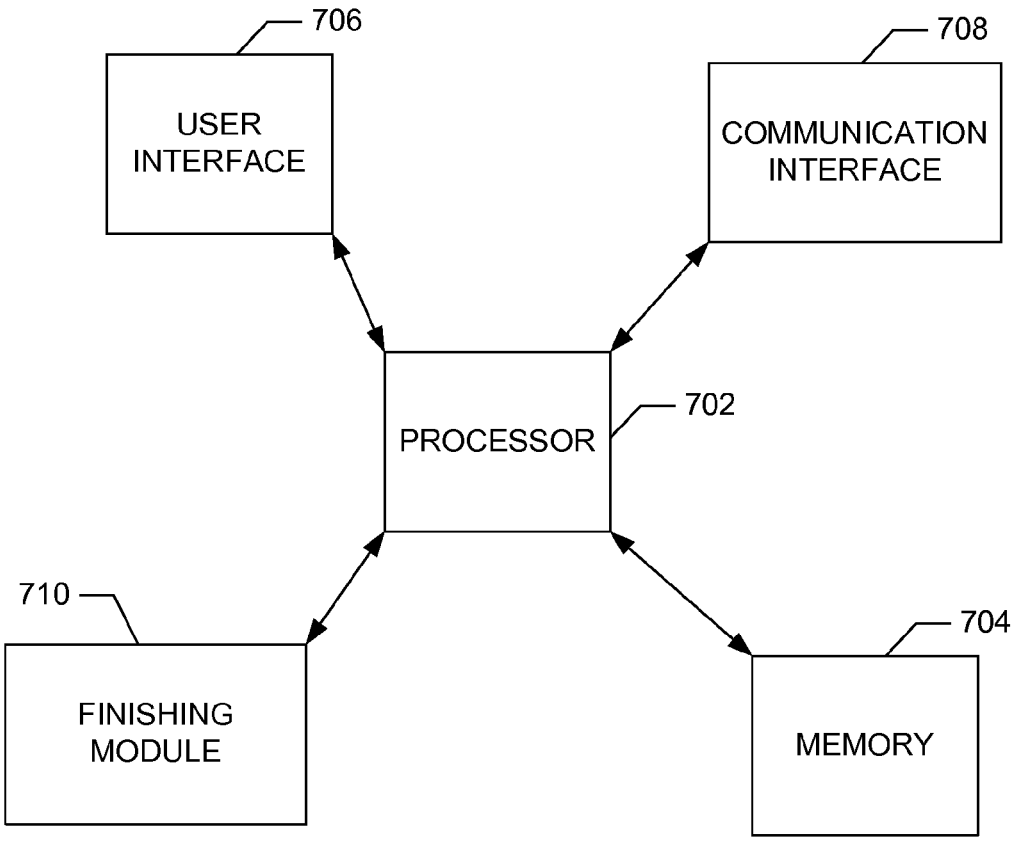
FIG. 18 schematically illustrates a block diagram of an electronic device according to an example embodiment of the present disclosure.

FIG. 18 is a block diagram of an electronic device 700 suitable for use with the described embodiments. In one example embodiment the electronic device 700 may be embodied in or as a controller configured for controlling manufacturing operations as disclosed herein. In this regard, the electronic device 700 may be configured to control or execute the above-described manufacturing operations performed by the CNC mill 200. In this regard, the electronic device 700 may be embodied in or as the controller 218.

The electronic device 700 illustrates circuitry of a representative computing device. The electronic device 700 may include a processor 702 that may be microprocessor or controller for controlling the overall operation of the electronic device 700. In one embodiment the processor 702 may be particularly configured to perform the functions described herein relating to manufacturing and finishing. The electronic device 700 may also include a memory device 704. The memory device 704 may include non-transitory and tangible memory that may be, for example, volatile and/or non-volatile memory. The memory device 704 may be configured to store information, data, files, applications, instructions or the like. For example, the memory device 704 could be configured to buffer input data for processing by the processor 702. Additionally or alternatively, the memory device 704 may be configured to store instructions for execution by the processor 702.

The electronic device 700 may also include a user interface 706 that allows a user of the electronic device 700 to interact with the electronic device. For example, the user interface 706 can take a variety of forms, such as a button, keypad, dial, touch screen, audio input interface, visual/image capture input interface, input in the form of sensor data, etc. Still further, the user interface 706 may be configured to output information to the user through a display, speaker, or other output device. A communication interface 708 may provide for transmitting and receiving data through, for example, a wired or wireless network such as a local area network (LAN), a metropolitan area network (MAN), and/or a wide area network (WAN), for example, the Internet.

The electronic device 700 may also include a finishing module 710. The processor 702 may be embodied as, include or otherwise control the finishing module 710. The finishing module 710 may be configured for controlling or executing the finishing operations and associated operations (e.g., conversion from a flood coolant system to a through spindle coolant system) as discussed herein.

In this regard, for example, in one embodiment a computer program product comprising at least one computer-readable storage medium having computer-executable program code portions stored therein is provided. The computer-executable program code portions, which may be stored in the memory device 704, may include program code instructions for performing the finishing operations and associated operations (e.g., conversion from a flood coolant system to a through spindle coolant system) disclosed herein.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A system configured to convert a flood coolant system to a through spindle coolant system, the system comprising:
- a conversion apparatus rotationally coupled to a rotary machine, the conversion apparatus comprising:
- a hollow shaft defining inlets configured to receive a coolant sprayed from an external nozzle therethrough; and
- a redirector positioned within the hollow shaft and configured to direct the coolant through the hollow shaft; and
- a rotary tool coupled to the hollow shaft, the rotary tool comprising:
  - a tool head defining outlets extending therethrough;
  - bristles coupled to the tool head; and
  - an abrasive material coupled to the tool head,
  - wherein the bristles and the abrasive material are water resistant and configured to conform to a shape of a component during rotation of the tool head about a rotational axis to affect a surface finish of the component, and
- wherein the rotary tool is configured to receive the coolant from the hollow shaft and direct the coolant out of the tool head through the outlets to the bristles and the abrasive material.

2. The system of claim 1, wherein the conversion apparatus further comprises a flow receptor wheel coupled to the hollow shaft, the flow receptor wheel comprising:
- a body portion;
- a plurality of scoops extending from the body portion; and
- apertures defined in the body portion, the scoops being configured to receive the coolant sprayed from the external nozzle and direct the coolant through the apertures in the body portion and into the inlets in the hollow shaft.

3. The system of claim 1, wherein the redirector cooperates with the hollow shaft to define a plurality of spiral shaped channels, wherein each spiral shaped channel of the plurality of spiral shaped channels is in communication with at least one of the inlets.

4. The system of claim 1, wherein the hollow shaft comprises a tool holder configured to engage a rotary tool.

5. The system of claim 1, wherein the hollow shaft is configured to engage a tool holder.

6. A method performed by a system for converting a flood coolant system to a through spindle coolant system, the method comprising:
- the system comprising: a conversion apparatus and a rotary tool, the conversion apparatus being rotationally coupled to a rotary machine, and the conversion apparatus comprising:
  - a hollow shaft defining inlets configured to receive a coolant sprayed from an external nozzle therethrough; and a redirector positioned within the hollow shaft and configured to direct the coolant through the hollow shaft; and the rotary tool being coupled to the hollow shaft, and the rotary tool comprising:

a tool head defining outlets extending therethrough;

bristles coupled to the tool head; and an abrasive material coupled to the tool head, wherein the bristles and the abrasive material are water resistant and configured to conform to a shape of a component during rotation of the tool head about a rotational axis to affect a surface finish of the component, rotating the conversion apparatus by the rotary machine;

spraying a coolant out of the external nozzle such that the coolant enters the inlets in the hollow shaft;

directing the coolant through the hollow shaft with the redirector; and receiving the coolant from the hollow shaft and directing the coolant out of the tool head through the outlets to the bristles and the abrasive material.

7. The method of claim 6, wherein spraying the coolant out of the external nozzle at the conversion apparatus comprises spraying the coolant at a flow receptor wheel coupled to the hollow shaft, the flow receptor wheel comprising a plurality of scoops configured to receive the coolant sprayed from the external nozzle and direct the coolant through a plurality of apertures defined in a body portion of the flow receptor wheel and into the inlets in the hollow shaft.

8. The method of claim 6, wherein directing the coolant through the hollow shaft comprises directing the coolant through a plurality of spiral shaped channels defined between the redirector and the hollow shaft.

9. The method of claim 6, further comprising engaging the hollow shaft with a tool holder.

10. The method of claim 6, further comprising:

directing the coolant from the hollow shaft out of the tool head through the outlets extending therethrough to the bristles and the abrasive material.

11. The system of claim 1, wherein the rotary tool further comprises a cone coupled to the tool head, the cone defining an upper opening configured to receive the coolant and direct the coolant downwardly through the tool head.

12. The system of claim 1, wherein the bristles and the abrasive material extend radially from the rotational axis of the tool head.

13. The system of claim 1, wherein the bristles comprise a plurality of polymer filaments and the abrasive material comprises a sandpaper, the plurality of polymer filaments are coupled to a back of the sandpaper, and the sandpaper comprises a plurality of tabs extending substantially parallel to the plurality of polymer filaments.

* * * * *